US005231799A

United States Patent [19]

Rowe et al.

[11] Patent Number: 5,231,799

[45] Date of Patent: Aug. 3, 1993

[54] RAIL FOLLOWING "Q"-HEIGHT GRINDER

[75] Inventors: William A. Rowe, Inverness; Paul Strauss, Chicago, both of Ill.

[73] Assignee: Zenith Electronics Corporation, Glenview, Ill.

[21] Appl. No.: 925,543

[22] Filed: Aug. 5, 1992

Related U.S. Application Data

[63] Continuation-in-part of Ser. No. 655,561, Feb. 13, 1991, Pat. No. 5,158,491.

[51] Int. Cl.[5] ..... B24B 49/00

[52] U.S. Cl. ..... 51/165.74; 51/165.75; 51/165.91; 409/178; 409/189; 409/132

[58] Field of Search ..... 51/165 R, 165.74, 165.75, 51/165.76, 165.77, 165.9, 165.91, 165.92, 283 R, 283 E, 32, 72 R; 409/131, 132, 178, 180, 151, 153, 184

[56] References Cited

U.S. PATENT DOCUMENTS

| | | | |
|---|---|---|---|
| 3,605,909 | 9/1971 | Lemelson | 173/3 |
| 3,858,363 | 1/1975 | Noll et al. | 51/105 R |
| 3,859,760 | 1/1975 | Grieb et al. | 51/165.75 |
| 4,908,995 | 3/1990 | Dougherty et al. | 51/281 R |
| 4,930,262 | 6/1990 | Sennewald | 51/165.76 |
| 5,086,591 | 2/1992 | Panetti | 51/165.75 |

*Primary Examiner*—William E. Terrell
*Assistant Examiner*—Eileen P. Morgan
*Attorney, Agent, or Firm*—Roland W. Norris

[57] ABSTRACT

A localized grinder is traversed in series over flat tension mask support rails affixed to a CRT front panel to produce a constant "Q"-height on the mask support surface above the rails. A local measuring device is used to develop point-specific rail height information relative to the screen edges for operation of the grinder in order to ascertain an effective "Q"-height measurement from the panel surface.

12 Claims, 3 Drawing Sheets

RAIL FOLLOWING "Q"-HEIGHT GRINDER

CROSS REFERENCED TO RELATED APPLICATIONS

This application is a continuation-in-part of application Ser. No. 07/655,561; Filed Feb. 13, 1991, now U.S. Pat. No. 5,158,491.

BACKGROUND OF THE INVENTION

1. Field of the Invention

The present invention relates to flat tension mask (FTM) color cathode ray tubes (CRT's) having the mask support structure affixed to the faceplate thereof. The present invention relates more specifically to means for attaining the accuracy necessary for predetermining the height of the "Q"-height mask support structures.

2. Discussion of the Related Art

Those familiar with the art of phosphor screen application to the faceplate of a common color cathode ray tube are aware of the advantages to be gained in production processes by making it possible to use shadow masks interchangeably with any screened faceplate. The assignee of the present invention manufactures a flat tension mask (FTM) color CRT. With the advent of the FTM, which utilizes a flat faceplate in conjunction with a thin foil shadow mask affixed in tension to mask support structures bonded to the flat faceplate, interchangeable mask technology is now practical. However, in order to meet the necessary registration demands for high resolution displays, the mask to screen distance, or "Q"-height, of the mask support structures must be maintained within very close tolerances. Due to dimensional inconsistencies of rail components as well as inconsistencies of the rail system affixation process, a procedure for grinding the mask support surface of the rail/panel assembly is considered a practical necessity. Indeed, in an interchangeable mask system utilizing offset printing to deposit the standard screen there are none of the mask to screen compensation factors inherent in photolithographic screen deposition. Therefore, "Q"-height control is critical to the functioning of such tubes.

In the past, it has been proposed to attain the necessary constancy of "Q"-height over the length of the mask support system by deforming the edges of the panel into intimacy with a true reference plane and then passing an abrasive grinding surface located in a parallel plane and at "Q"-height distance, over the rails to ensure the proper "Q"-height. See, e.g., U.S. Pat. No. 4,908,995, commonly owned herewith. However, the fixturing required for such a system may induce large forces and cause damage to the panel glass if the panel plane reference points are too hard, or introduce inconsistencies in "Q"-height if the reference points are subject to wear or deformation. Further, the "Q"-height measurements of such a system are based on the placement of the panel face periphery against reference stops. An assumption exists in this sort of grinding that the screen area of the panel is thereby placed in the same plane as the panel face periphery, resulting in adequate "Q"-height control. Greater accuracy of "Q"-height control can be attained by foregoing this assumption and instead measuring rail height from the periphery of the screen area resulting in a more effective "Q"-height measurement.

Therefore, it is desirable to provide a grinder which can establish a constant "Q"-height without requiring potentially destructive deformation of the panel.

Such a constant "Q"-height front panel, produced with nondestructive fixturing means, is particularly useful in a standardized screen printing system, such as elaborated in the parent 30 application U.S. Ser. No. 07/655,561, filed Feb. 13, 1991, now U.S. Pat. No. 5,158,491 and even more so in the aforementioned offset printing of screens. Said parent application is herein incorporated by reference to avoid lengthy exposition of background unnecessary to those ordinarily skilled in the art. It is therefor an object of the present invention to attain an accurate closely controlled "Q"-height for the mask support system affixed to the faceplate, as described above, with minimal injurious fixturing required during rail grinding.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DETAILED DESCRIPTION OF PREFERRED EMBODIMENT

Figure 1:
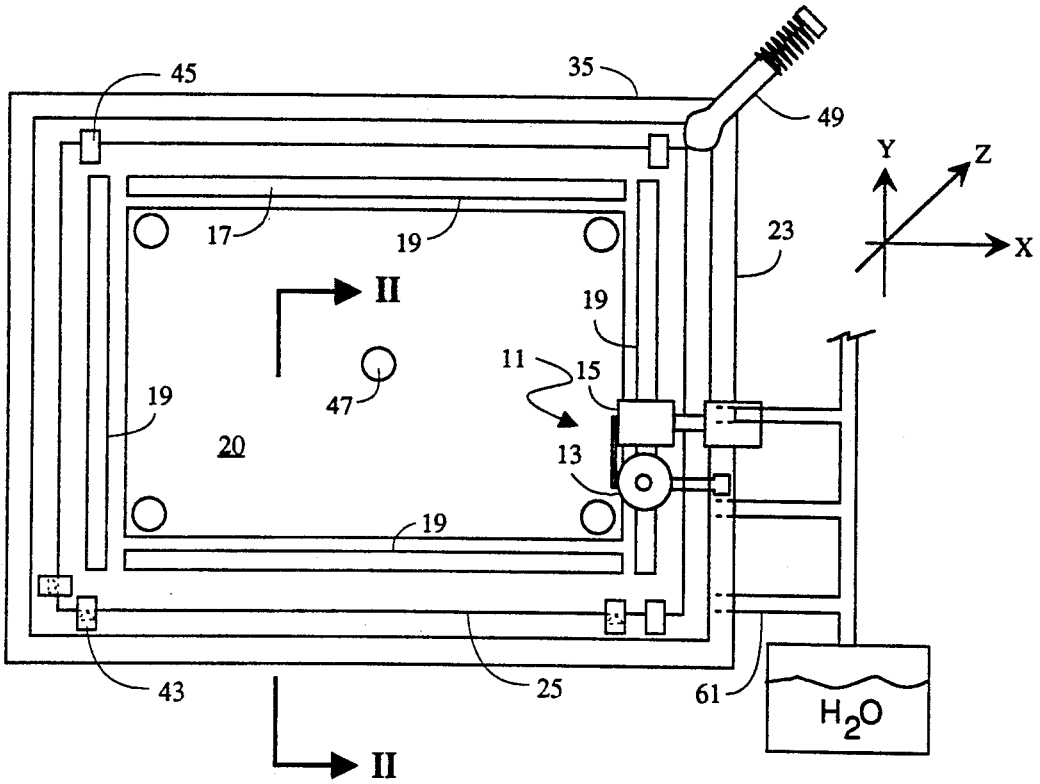
FIG. 1 is a top view of the apparatus of the present invention.

As seen in FIG. 1 a panel 25 having rails 19 for supporting a shadow mask (not shown) on the mask support surfaces 17 thereof, is inserted into a fixturing apparatus 35 for support during the grinding of the mask support surfaces 17 by the rail grinding apparatus 11. The rails 19 bound the screen area 20 of the panel 25. The X,Y, and Z axes are used in the traditional sense of the CRT art, with X being the long axis of a rectangular panel, Y the short axis, and Z being perpendicular to the panel.

Figure 2:
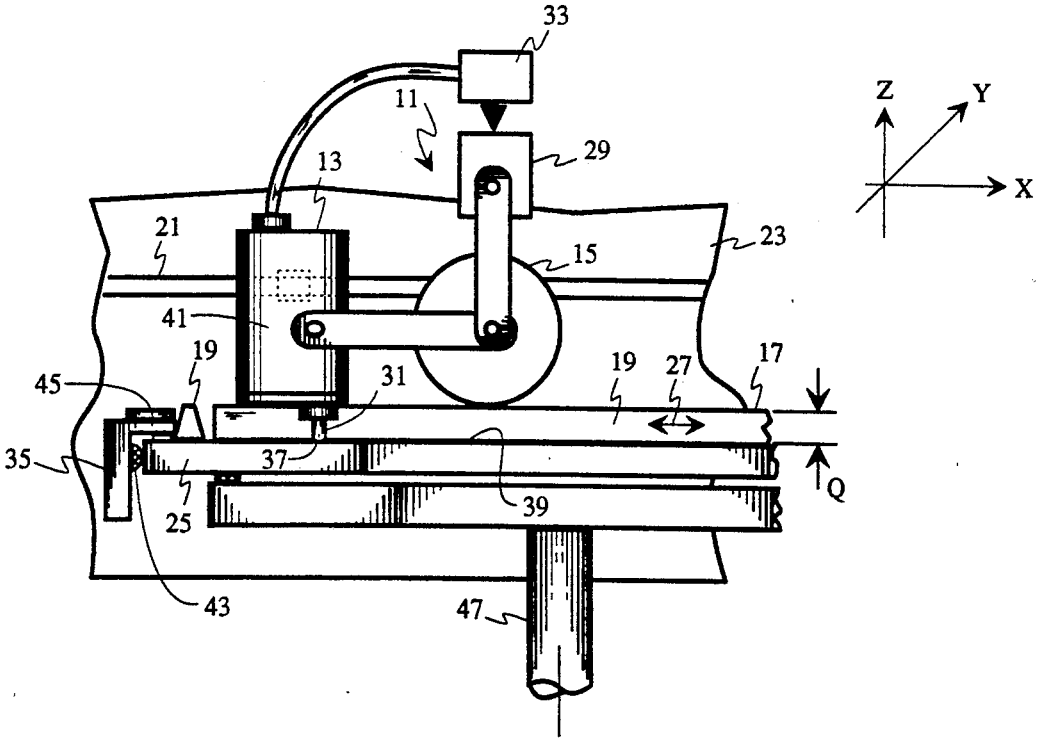
FIG. 2 is a side view taken along the line II—II of FIG. 1.

As seen in FIG. 2 the "rail-follower" rail grinding apparatus 11 includes a rail height measuring device 13 operably connected to a grinder 15 suitably dimensioned to grind locally and in series, the mask support surface 17 of a rail 19. The grinding apparatus 11 is movably connected to a track 21 and wall 23 surrounding the panel 25 and to suitable motive means (not shown) to enable the grinding apparatus 11 to travel along the longitudinal axis 27 of the rail 19. The grinder 15 is also movable in the Z-axis, i.e., up and down in FIG. 2, by an actuator 29 which is connected physically and electronically to the rail height measuring device 13. The measuring device 13 includes a transducer 31 whose bottom surface 37 is biased onto the screening surface 39 of the panel 25. The transducer 31 is connected to a casing 41 which rides on the mask support surface 17. Thus the transducer 31 gives a localized readout of the actual rail height above the screen. The rail height, before grinding, is designed to be greater than the desired mask to screen spacing, or "Q"-height, in order to allow for the rail grinding. The measuring device 13 thereby generates signals into a controller 33. The controller 33 then provides suitable time delays or longitudinal position data, height information, etc. for controlling Z-axis movement of the grinder 15 through the actuator 29 to establish a constant "Q" height for the mask support surfaces 17.

Figure 4:
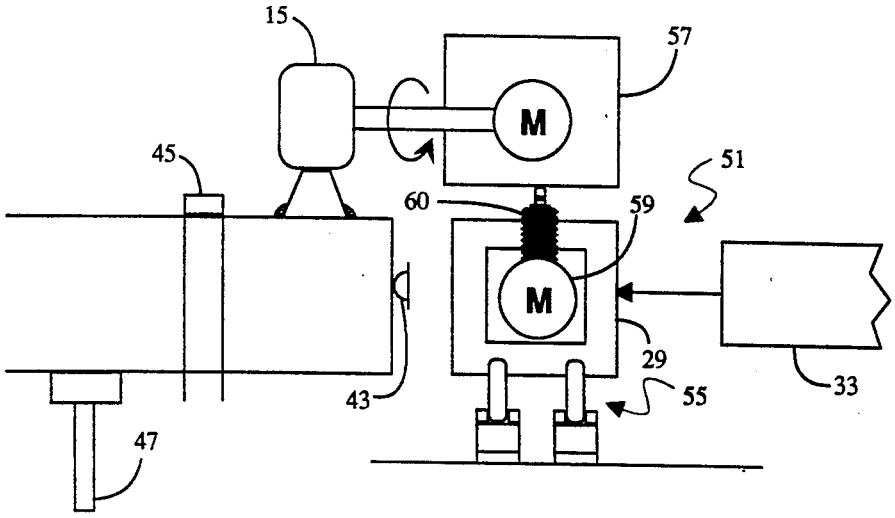
FIG. 4 is an elevation taken along line IV—IV of FIG. 3.

As seen in FIGS. 1 and 4, the fixturing apparatus 35 includes horizontal, or X-Y panel positioners 43, vertical, or Z-axis, panel positioner 45, a Z-axis biassing force means 47, and a horizontal biassing force means 49 for maintaining the panel in position during grinding.

Figure 3:
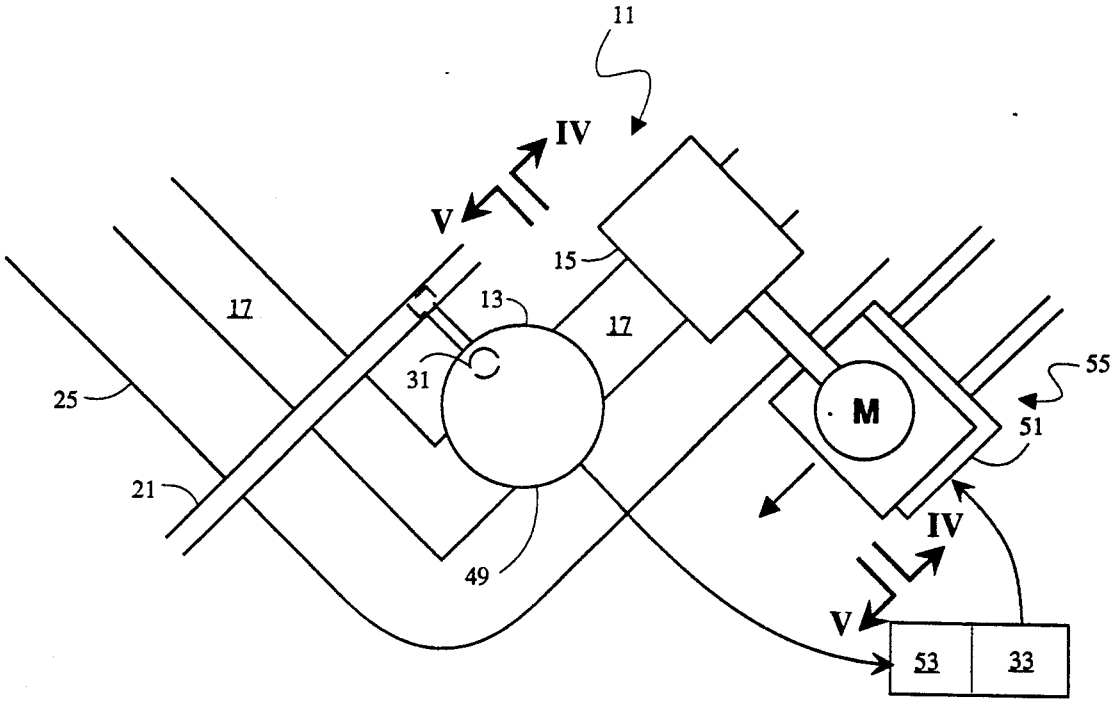
FIG. 3 is a top perspective view of an alternative embodiment separating the measurement and grinding assemblies.
Figure 5:
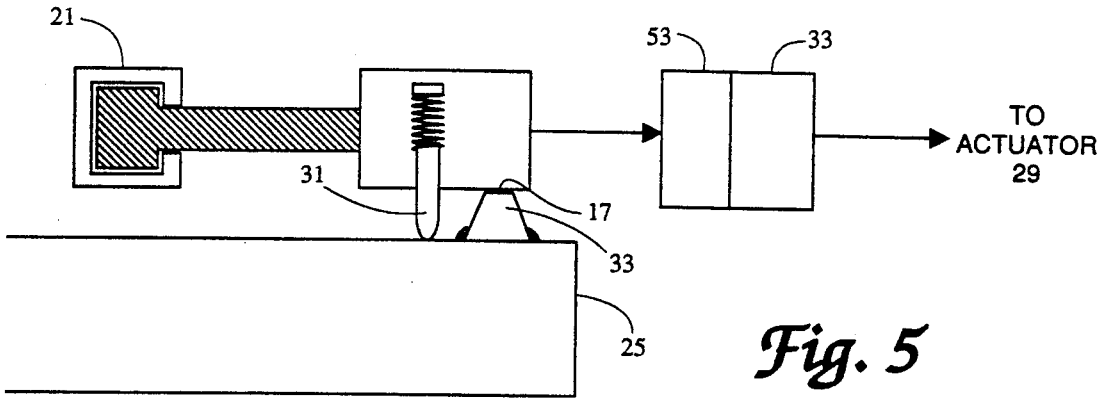
FIG. 5 is an elevation taken along line V—V of FIG. 3.

Alternatively, as seen in FIGS. 3–5, it may be desirable to separate the rail measuring device 13 from the grinder 15 and its associated motive means 51, such that the measuring device 13 may be withdrawn from the path of the grinder 15 when using a closed rail frame such as illustrated in FIG. 3. In such case, it is necessary to develop a positional data file 53 which develops and stores correlated longitudinal rail position and rail height data. This data is then fed to the grinder controller 33 for controlling the height of the grinder 15 and hence the amount of mask support surface removed to attain the desired "Q"-height. Alternatively, air jet measuring devices, other non-contact measurers, may be used in place of the electromechanical transducer shown.

As seen in FIG. 4, the grinder motive means 51 comprises a track and wheel system 55 operably connected to the Z-axis actuator 29 which in turn supports the means 57 for rotating the grinder 15. The Z-axis actuator 29 is provided with a suitable motor 59 and screw 60 for positioning the grinder rotation means 57, and hence the grinder 15, according to the positional data received from the controller 33. Multiple passes of the rail grinding apparatus 11 are contemplated in order to eliminate the need for measuring grinder wear.

Figure 6:
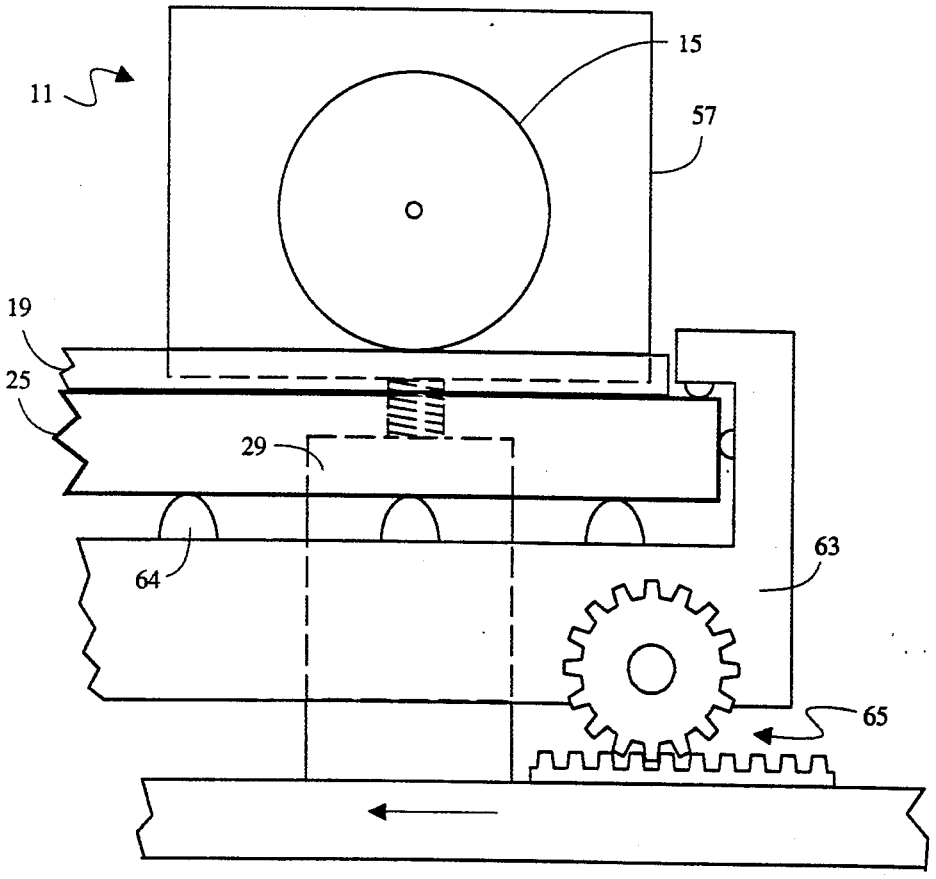
FIG. 6 is an alternative embodiment wherein the grinding assembly remains stationary.

As seen in FIG. 1, coolant jets 61 are suitably placed near the grinder 15 for facilitating the rail grinding procedure. It will also be realized by the ordinary artisan that the conformable support as taught in the aforementioned parent application can be suitably used in place of the vertical force means 47. As seen in FIG. 6, the use of the conformable support 63, wherein the panel 25 is supported with pins 64 that place no additional force on the panel 15 other then reaction to grinding forces, allows the grinder 15 and its vertical actuator 29 and rotation means 57 to remain in a fixed horizontal position while the rail 19 is moved underneath the grinder 15 by motive means 65 connected to the conformable support 63.

While particular embodiments of the invention have been shown and described, it will be readily apparent to those skilled in the art that changes and modifications may be made in the present invention without departing from the spirit thereof, and therefor, the purpose of the appended claims is to cover all such changes and modifications as fall within the true spirit and scope of the invention.

What is claimed is:

1. A method of creating a constant mask support surface height on a mask supporting rail affixed to a screening surface of a CRT front panel comprising:

a) measuring the rail height above the panel substantially along the length of the rail, b) transferring the rail height measurement data to a Z-axis adjustable grinder, c) causing relative motion between the grinder and the rail so as to place the grinder longitudinally along the rail in a position for locally grinding the rail, and, d) adjusting the position of the grinder in the Z-axis according to the longitudinal position of the grinder and the rail height measurement data and grinding the rail to a constant "Q" height substantially along the length of the rail.

2. The method of claim 1 further comprising:

fixturing the panel with sufficient force to resist the grinding force but without sufficient force to deform or damage the panel.

3. The method of claim 2 wherein the step of fixturing the panel further includes supporting the panel with a conformable support which places no additional pressure on the panel other than reaction to grinding forces.

4. The method of claim 2 wherein the step of fixturing the panel further includes forcing the panel against positioning stops.

5. The method of claim 1 wherein the step of causing relative motion further comprises causing the grinder to move along the rail.

6. The method of claim 1 wherein the step of causing relative motion further comprises causing the panel to move in relation to the grinder.

7. The method according to claim 1 wherein the step of transferring the rail height measurement data includes developing a positional data file which correlates and stores the longitudinal rail position and rail height data before transferring that data to the adjustable grinder.

8. The method of claim 1 wherein step (a) thereof further comprises measuring the rail height in relation to the screen area of the panel.

9. An apparatus for creating a constant mask support surface height on a mask supporting rail affixed to the screening surface of a CRT front panel according to the method of claim 1, comprising:

a) a rail height measuring apparatus for taking rail height measurements at a numerosity of positions along the length of the rail, b) a grinder constructed and arranged so as to locally grind the mask support surface of the rail, c) an actuator for controlling the Z-axis placement of the grinder, d) means for conveying the numerosity of rail height measurements to the actuator, e) means for positioninq the grinder and actuator at a numerosity of positions along the length of the rail.

10. The apparatus of claim 9 wherein the means for positioning the grinder and actuator includes a means for moving the grinder and actuator along the length of the rail.

11. The apparatus of claim 9 further including means for fixturing the panel against displacement through contact with the grinder without damaging or deforming the panel.

12. The apparatus of claim 9 wherein the means for positioning the grinder and actuator includes means for moving the rail in relation to the grinder and actuator.

* * * * *